US010590621B2

(12) United States Patent
Kim

(10) Patent No.: US 10,590,621 B2
(45) Date of Patent: Mar. 17, 2020

(54) STRIP-TYPE REINFORCING MATERIAL AND REINFORCING MATERIAL ASSEMBLY COMPRISING SAME

(71) Applicant: DAIHAN CORK CO., LTD., Seoul (KR)

(72) Inventor: Jae Hong Kim, Seoul (KR)

(73) Assignee: DAIHAN CORK CO., LTD., Seoul (KR)

( * ) Notice: Subject to any disclaimer, the term of this patent is extended or adjusted under 35 U.S.C. 154(b) by 0 days.

(21) Appl. No.: 16/312,326

(22) PCT Filed: May 26, 2017

(86) PCT No.: PCT/KR2017/005522
§ 371 (c)(1),
(2) Date: Dec. 21, 2018

(87) PCT Pub. No.: WO2018/004132
PCT Pub. Date: Jan. 4, 2018

(65) Prior Publication Data

US 2019/0242088 A1 Aug. 8, 2019

(30) Foreign Application Priority Data

Jun. 29, 2016 (KR) ..... 10-2016-0082137

(51) Int. Cl.
*E02D 29/02* (2006.01)
*E02D 17/08* (2006.01)
*E02D 17/04* (2006.01)

(52) U.S. Cl.
CPC ..... *E02D 29/0225* (2013.01); *E02D 17/04* (2013.01); *E02D 17/08* (2013.01);
(Continued)

(58) Field of Classification Search
CPC ..... E02D 29/0225; E02D 29/0233; E02D 29/0241
(Continued)

(56) References Cited

U.S. PATENT DOCUMENTS 1,762,343 A * 6/1930 Munster ..... E02D 29/0225 405/262
3,421,326 A * 1/1969 Vidal ..... E02B 3/06 405/284
(Continued)

FOREIGN PATENT DOCUMENTS

JP 60138121 A * 7/1985 ..... E02D 29/0225
JP 02183015 A * 7/1990 ..... E02D 29/0225
(Continued)

*Primary Examiner* — Frederick L Lagman
(74) *Attorney, Agent, or Firm* — Novick, Kim & Lee, PLLC; Jae Youn Kim

(57) ABSTRACT

Provided are a strip-type reinforcing material and a reinforcing material assembly having the same. The strip-type reinforcing material includes: strip bases extending in one direction and made of a flexible material; and resistance means protruding from respective upper and lower parts of the strip bases. Multiple resistance means are provided along the strip bases. The resistance means includes: a first resistance part protruding from the upper parts of the strip bases and having an opening being open in a direction parallel to a longitudinal direction of the strip bases; and a second resistance part protruding from the lower parts of the strip bases and having an opening being open in an opposite direction to the opening of the first resistance part.

7 Claims, 4 Drawing Sheets

(52) U.S. Cl.
CPC ..... *E02D 29/02* (2013.01); *E02D 29/025* (2013.01); *E02D 29/0241* (2013.01); *E02D 2200/1692* (2013.01); *E02D 2600/40* (2013.01)

(58) Field of Classification Search
USPC ..... 405/262
See application file for complete search history.

(56) References Cited

U.S. PATENT DOCUMENTS 3,570,252 A * 3/1971 Vidal ..... E02D 29/0241 405/114
4,116,010 A * 9/1978 Vidal ..... E04C 5/03 405/262
5,169,266 A * 12/1992 Sala ..... C23F 13/02 204/196.19
5,372,461 A * 12/1994 Nanayakkara ..... E02D 29/0241 405/262
5,419,659 A * 5/1995 Mercer ..... B29D 28/00 405/16
5,807,030 A * 9/1998 Anderson ..... E02D 29/02 405/262
5,860,771 A * 1/1999 Ditcher ..... E02D 29/0233 405/262
6,224,295 B1 * 5/2001 Price ..... E02D 29/025 405/262
6,427,417 B1 * 8/2002 Sagy ..... E02D 5/74 405/262
2005/0265792 A1 * 12/2005 Lee ..... E02D 29/0225 405/286
2007/0009331 A1 * 1/2007 Lee ..... E02D 29/0241 405/262
2008/0267718 A1 * 10/2008 Costin ..... E02D 29/0225 405/262
2012/0183360 A1 * 7/2012 Sanders ..... E02D 29/0241 405/262
2018/0274196 A1 * 9/2018 Amrein ..... E02D 29/025

FOREIGN PATENT DOCUMENTS

JP 07-268868 A 10/1995
JP 2002-227206 A 8/2002
KR 10-2002-0076558 A 10/2002
KR 10-2006-0034611 A 4/2006
KR 10-2014-0089735 A 7/2014
WO WO-2004053239 A1 * 6/2004 ..... E02D 29/0233

* cited by examiner

STRIP-TYPE REINFORCING MATERIAL AND REINFORCING MATERIAL ASSEMBLY COMPRISING SAME

TECHNICAL FIELD

The present invention relates to a strip-type reinforcing material. More particularly, the present invention relates to a strip-type reinforcing material and a reinforcing material assembly, wherein the strip-type reinforcing material is configured such that one end thereof is secured to a reinforcing block while the other end thereof is installed in backfill soil, thus reinforcing a tensile strength of soil.

BACKGROUND ART

As well known in the art, a block-type retaining wall structure formed by stacking multiple blocks is constructed in areas of terrain possessing undesirable slopes, such as an embankment, a mountainside, and the like to retain soil, thus preventing the soil from sliding and collapsing. In such a reinforced soil retaining wall, a reinforcing material for combining retaining wall blocks and backfill soil (reinforced soil mass) is generally used.

A geogrid, which is a type of reinforcing material, is in the form of a net. Recently, a strip-type reinforcing material has been used, the strip-type reinforcing material being inserted into a fitting groove formed on an upper surface of respective retaining wall blocks assembled on a front surface of the reinforced soil retaining wall, thus being installed in a zigzag pattern in backfill soil.

In other words, in order to reinforce the tensile strength of soil, a strip-type fiber reinforcing material is installed on stacked blocks. Such a fiber reinforcing material is configured such that one end thereof is secured to a block by using an anchor, an anchor pin, or the like while the other end thereof extends to be buried in soil. This results in reinforced soil mass being formed through friction generated at the interface of the reinforcing material and the soil such that the retaining wall can resist external forces such as earth pressure.

When the blocks for forming the retaining wall are supported by using such a strip-type fiber reinforcing material, one end of the strip-type fiber reinforcing material is hooked to a connecting ring protruding from a rear surface of each block, and the other end of the strip-type fiber reinforcing material having one end hooked to the connecting ring is hooked to a support bar secured to the front of a support wall spaced rearwardly of the blocks, such that the strip-type fiber reinforcing material is continuously installed in a zigzag pattern. Thereafter, reinforced soil is filled between the blocks and the support wall to form a retaining wall structure.

However, such fiber reinforcing materials are insufficient in frictional resistance against soil, and it is often necessary for the length of the reinforcing material to extend more than necessary when performing a stability examination. Although the frictional resistance can be improved by extending the length of the fiber reinforcing material, this results in backfill soil being increased in earth volume and which is disadvantageous in terms of constructability and economic efficiency.

Furthermore, in the process of installing strip-type reinforcing materials in a zigzag pattern, the strip-type reinforcing materials are changed in orientation. Due to this, when the strip-type reinforcing materials have an orientation, it is necessary to perform construction while considering the orientation of the strip-type reinforcing materials. This may lead to degradation in convenience of construction.

Furthermore, regarding as a technique for securing a fiber reinforcing material in position, there is used a technique in which the fiber reinforcing material is wound between blocks constituting a retaining wall so as to be compressed by the weight of the blocks and secured. However, if the blocks are loosened and thus a gap is defined therebetween, the fiber reinforcing material is likely to be released therethrough, leading to a reduction in passive resistance.

In an effort to overcome such disadvantages, steel, which is an inhomogeneous material, may be used as a reinforcing material. Such a steel reinforcing material has a passive resistance body provided at a rear end thereof to increase frictional resistance, which is advantageous over the fiber reinforcing material in terms of passive resistance performance due to the characteristics of the steel. However, such a metal reinforcement material made of steel or the like is disadvantageous in that material costs may be significantly increased while constructability may be relatively degraded due to provision of the passive resistance body.

DISCLOSURE

Technical Problem

Accordingly, the present invention has been made keeping in mind the above problems occurring in the related art, and an objective of the present invention is to provide a strip-type reinforcing material having resistance means to increase passive resistance of the strip-type reinforcing material.

Another objective of the present invention is to provide a strip-type reinforcing material that can be conveniently constructed without orientation.

Still another objective of the present invention is to provide a reinforcing material assembly having a strip-type reinforcing material to facilitate construction of the reinforcing material.

Technical Solution

In order to accomplish the above objectives, according to an aspect of the present invention, there is provided a strip-type reinforcing material, including: a strip base extending in one direction and made of a flexible material; and resistance means protruding from respective upper and lower parts of the strip base, wherein, multiple resistance means are provided to be arranged along the strip base, and the resistance means includes: a first resistance part protruding from the upper part of the strip base and having an opening being open in a direction parallel to a longitudinal direction of the strip base; and a second resistance part protruding downwardly of the strip base and having an opening being open in an opposite direction to the opening of the first resistance part.

The first resistance part and the second resistance part may have a first pocket and a second pocket, respectively, the first pocket and the second pocket each having the opening being open in one direction, the first pocket and the second pocket being gradually widened toward the openings.

The first resistance part and the second resistance part may be provided continuously at the strip base in directions facing each other, such that the first pocket and the second pocket are connected to each other.

The strip base may include: a base body having reinforcing means provided therein; and a resistance body provided between adjacent base bodies and having the resistance means.

The reinforcing means provided in the base body may be provided as a pair of reinforcing means, and the reinforcing means may be separated from each other.

At least one of the base body and the resistance body may have a friction surface formed on an outer surface thereof.

According to another aspect of the present invention, there is provided a reinforcing material assembly, including: a mounting block provided on a front of a soil mass such that multiple mounting blocks are stacked on top of each other or arranged side by side; and a strip-type reinforcing material connected at a portion thereof to the mounting block and installed in the soil mass, thus improving passive resistance, wherein the mounting block includes: a block body having an insertion groove into which the portion of the strip-type reinforcing material is inserted and seated and a seat surface formed by recessing at least a portion of the block body by a thickness of the strip-type reinforcing material, and the strip-type reinforcing material includes: a strip base extending in one direction and made of a flexible material; and resistance means protruding from respective upper and lower parts of the strip base, the resistance means including a first resistance part protruding from the upper part of the strip base and a second resistance part protruding from the lower part of the strip base.

The first resistance part may protrude from the upper part of the strip base and have an opening being open in a direction parallel to a longitudinal direction of the strip base, a second resistance part may protrude from the lower part of the strip base and have an opening being open in an opposite direction to the opening of the first resistance part, and the first resistance part and the second resistance part may have a first pocket and a second pocket, respectively, the first pocket and the second pocket each having the opening being open in one direction.

The insertion groove of the mounting block may include: a reinforcing material insertion groove formed as a pair such that the portion of the strip-type reinforcing material is hooked in a standing state and then extends in an opposite direction; and a post insertion groove into which a hook post is inserted, the hook post on which the portion of the strip-type reinforcing material seated on the seat surface is hooked in a lying state.

Advantageous Effects

The strip-type reinforcing material according to the present invention as described above and the reinforcing material assembly having the same have the following effects.

The multiple resistance means are provided along the longitudinal direction of the strip-type reinforcing material, thus making it possible to significantly improve passive resistance and pull-out resistance of the strip-type reinforcing material, resulting in improvement of stability of a reinforced soil retaining wall.

Furthermore, pull-out resistance is improved, leading to a reduction in number of strip-type reinforcing materials being installed and installation length of the strip-type reinforcing material. This makes it possible to reduce the volume of earthworks such as soil transportation, excavation, backfill soil installation, and compaction, thus improving constructability and economic efficiency of the reinforced soil retaining wall.

In particular, the strip-type reinforcing material is provided with the resistance means having a vertically/horizontally symmetrical structure, and thus resistance is improved both in the direction toward the retaining wall and in the opposite direction. This makes it possible for the strip-type reinforcing material to find application in various environments and structures, thus increasing utilization of the strip-type reinforcing material.

Furthermore, requirement of a specific installation orientation is eliminated due to the symmetrical structure of the strip-type reinforcing material, thus making it possible for the strip-type reinforcing material to be more conveniently constructed.

Furthermore, operation of winding a portion of a strip-type reinforcing material on a structure or the like is omitted, while operation of inserting the strip-type reinforcing material into the mounting block is performed, thus making it possible for the strip-type reinforcing material to be easily installed. This results in improvement of constructability and shortening of construction period.

Furthermore, the strip-type reinforcing material is mounted on the mounting block in various methods, thus making it possible to select a mounting method for the strip-type reinforcing material according to site conditions.

MODE FOR INVENTION

Figure 1:
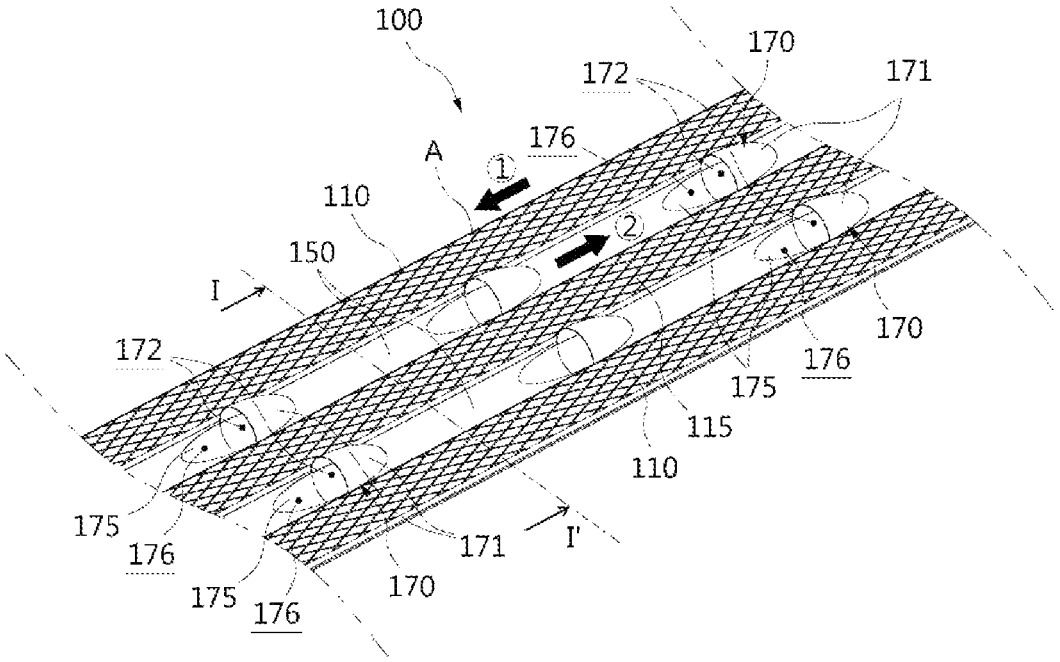
FIG. 1 is a perspective view showing a part a strip-type reinforcing material according to an embodiment of the present invention.

Hereinafter, exemplary embodiments of the present invention will be described in detail with reference to the accompanying drawings. Like reference numerals are used to identify like elements throughout different drawings. Further, in the following description, if it is decided that the detailed description of a known function or configuration related to the invention makes the subject matter of the invention unclear, the detailed description is omitted.

Furthermore, when describing the components of the present invention, terms such as first, second, A, B, (a) or (b) may be used. Since these terms are provided merely for the purpose of distinguishing the components from each other, they do not limit the nature, sequence or order of the components. It will be understood that when an element is referred to as being "connected", "coupled", or "linked" to another element, it can be directly connected or coupled to the latter or be indirectly "connected", "coupled", or "linked" with a third element interposed therebetween.

A strip-type reinforcing material 100 according to the present invention is installed in a soil mass, such as backfill soil B and the like being constructed, and serves to reduce earth pressure through friction with the backfill soil B such that the backfill soil B is restrained against lateral deformation. More specifically explained, earth pressure is reduced through friction between the backfill soil B and the strip-type reinforcing material 100, leading to an increase in adhesion and internal friction angle of the backfill soil B. This leads to improvement of shear strength of the backfill soil B, thus obtaining a stable reinforced soil. The strip-type reinforcing material 100 according to the present invention is configured such that multiple strip-type reinforcing materials are installed in the backfill soil B in a layered structure, and a detailed description thereof will be described below.

The strip-type reinforcing material 100 is formed in a thin strip shape and is generally made of a flexible material. In this embodiment, the strip-type reinforcing material 100 is made of a synthetic resin material, but is not limited thereto. For example, the strip-type reinforcing material 100 may be made of a polymer material or may be made of a high strength polyester fiber or may be made by covering the high strength polyester fiber with polyethylene.

The strip-type reinforcing material 100 extends in one direction to be installed in the backfill soil B in a zigzag pattern, such that a portion of the strip-type reinforcing material 100 is connected to be secured to a mounting block 200 that will be described later. The strip-type reinforcing material 100 is changed in extending direction while the portion thereof is secured to the mounting block 200.

Figure 2:
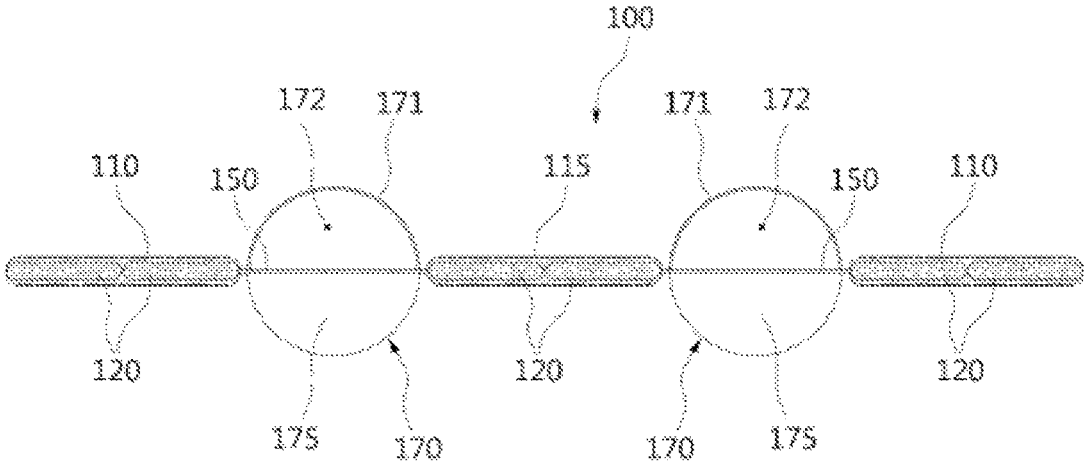
FIG. 2 is a cross-sectional view taken along line I-I' of FIG. 1.

FIG. 1 and FIG. 2 show the embodiment of the strip-type reinforcing material 100. As shown in these figures, the strip-type reinforcing material 100 extends in one direction and is partially shown in FIG. 1. The strip-type reinforcing material 100 includes strip bases 110 and 150 and resistance means 170 provided at the strip bases 110 and 150. The strip bases 110 and 150 and the resistance means 170 are each made of a flexible material and may be made of the same or different materials.

The strip bases 110 and 150 of the strip-type reinforcing material 100 extend in one direction and may be divided into a base body 110 and a resistance body 150. Herein, the base body 110 may be a portion of the strip-type reinforcing material 100 being not provided with the resistance means 170, and the resistance body 150 may be a portion being provided with the resistance means 170. In this embodiment, the base body 110 is positioned at the opposite sides the strip-type reinforcing material having the strip bases 110 and 150, and the resistance body 150 is positioned between the base bodies 110. Reference numeral 115 denotes a base body 110 which is any one of the base bodies 110 and is provided between resistance bodies 150.

As shown in FIG. 2, reinforcing means 120 is provided in the strip bases 110 and 150. The reinforcing means 120 is adapted to reinforce the strength of the strip bases 110 and 150 and thereby reinforce the strength of the entire strip-type reinforcing material 100. The reinforcing means 120 is inserted into the base body 110 and in this embodiment is made of a polyester material. More specifically explained, the reinforcement means 120 of the base body 110 is made of a polyester material and is coated with a PVC coating. The reinforcing means 120 and the base body 110 covering the reinforcing means 120 may vary in material.

In this embodiment, the reinforcing means 120 is provided as a pair of reinforcing means, and the reinforcing means are separated from each other in the base body 110. As shown in FIG. 2, the pair of reinforcing means 120 are provided in the base body 110 to be separated from each other, resulting in an increase in number of the reinforcing means 120. The pair of reinforcing means 120 are advantageous over one reinforcing means 120 having the same volume in terms of reinforcement of strength. This configuration also provides advantages in that the strip-type reinforcing material 100 including the reinforcing means 120 is easy to manufacture.

The resistance body 150 is provided with the resistance means 170. The resistance means 170 protrudes from respective upper and lower parts of the strip bases 110 and 150 and serves to increase passive resistance between soil and the strip-type reinforcing material 100. Multiple resistance means 170 may be provided along the strip bases 110 and 150 to increase passive resistance.

The resistance means 170 includes a first resistance part 171 and a second resistance part 175. The first resistance part 171 protrudes from the upper parts of the strip bases 110 and 150 and has an opening being open in a direction parallel to a longitudinal direction of the strip bases 110 and 150. The second resistance part 175 protrudes from the lower parts of the strip bases 110 and 150 and has an opening being open in the opposite direction to the opening of the first resistance part 171.

In other words, the first resistance part 171 and the second resistance part 175 are formed at the strip bases 110 and 150 in directions opposite to one another. The first resistance part 171 and the second resistance part 175 respectively have pockets 172 and 176 being open in directions opposite to one another with respect to the longitudinal direction of the strip bases 110 and 150. The first resistance part 171 and the second resistance part 175 protrude in directions opposite to one another also in a vertical direction (vertical direction with respect to FIG. 2).

Figure 3:
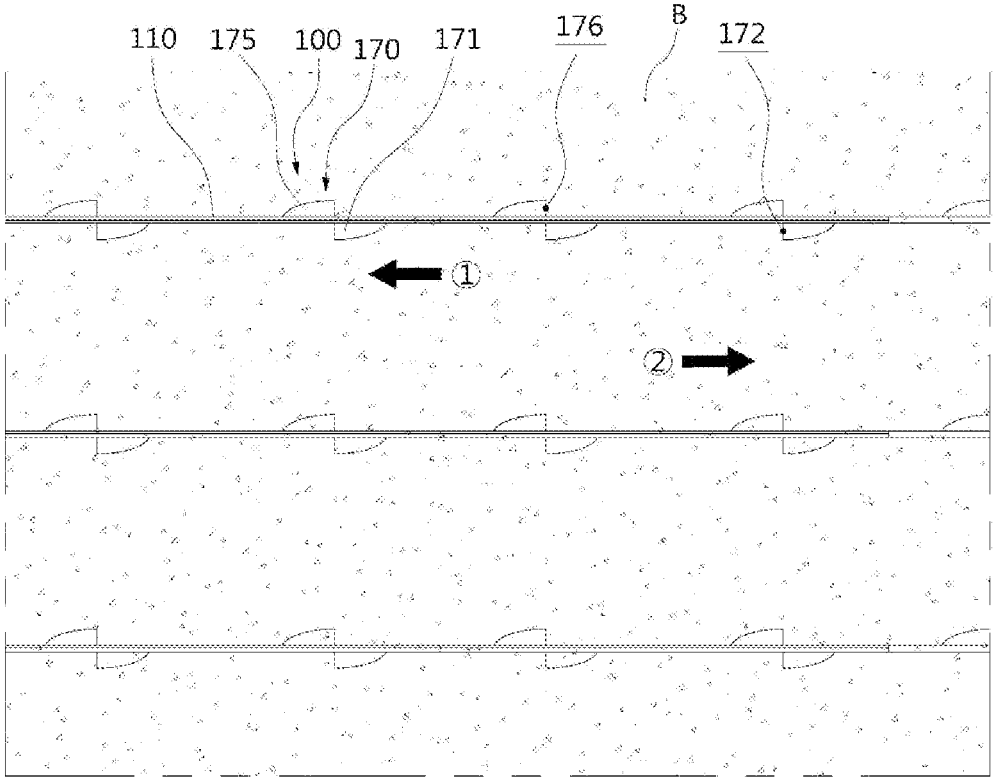
FIG. 3 is a schematic view showing a state in which the strip-type reinforcing material according to the embodiment of the present invention is constructed.

More specifically explained, as shown in FIG. 3, the first resistance part 171 and the second resistance part 175 in directions opposite to one another also in the vertical direction. Furthermore, a first pocket 172 of the first resistance part 171 and a second pocket 176 of the second resistance part 175 are formed in directions opposite to one another.

As a result, the first resistance part 171 and the second resistance part 175 are formed at the strip bases 110 and 150 in directions opposite to one another with respect to two directional axes. Accordingly, the strip-type reinforcing material 100 has improved resistance both in the direction toward a retaining wall and in the opposite direction thereof, thus making it possible for the strip-type reinforcing material 100 to find application in various environments and structures. Furthermore, requirement of a specific installation orientation is eliminated due to a symmetrical structure, thus making it possible for the strip-type reinforcing material 100 to be more conveniently constructed.

Meanwhile, in this embodiment, the first resistance part 171 and the second resistance part 175 are provided continuously at the strip bases 110 and 150 in directions facing each other. Accordingly, in the process of manufacturing the strip-type reinforcing material 100, the first resistance part 171 and the second resistance part 175 are cut therebetween and then bent in a direction of being opened in opposite directions, thus being easy to form.

Herein, a part of the backfill soil B flows into the first pocket 172 of the first resistance part 171 while the strip-type reinforcing material 100 is pulled toward the retaining wall. In this process, the second pocket 176 of the second resistance part 175 may help inflow of the soil. The second resistance part 175 is inclined downward toward the first pocket 172 of the first resistance part 171, thus making it possible to allow soil to flow in more naturally. In other words, while the strip-type reinforcing material 100 is pulled toward the mounting block 200 due to earth pressure or the like, the backfill soil B is further inserted into the first pocket 172, leading to an increase in resistance.

Furthermore, the second pocket 176 of the second resistance part 175 and the first pocket 172 of the first resistance part 171 are open in directions facing each other to be connected to each other, resulting in an increase in total volume of the pockets of the resistance means 170. This makes it possible to further increase passive resistance exerted by the resistance means 170.

The first pocket 172 of the first resistance part 171 and the second pocket 176 of the second resistance part 175 are gradually widened toward the openings. Accordingly, when an external force exerts on the strip-type reinforcing material 100 in the direction toward the retaining wall, the area of a friction surface A formed by the openings is sufficiently ensured, resulting in an increase in passive resistance.

In this embodiment, the first pocket 172 and the second pocket 176 are open downwardly and upwardly of the strip-type reinforcing material 100, respectively. The first pocket 172 and the second pocket 176 may be closed downwardly and upwardly of the strip-type reinforcing material 100, respectively, but may have an open structure as in this embodiment in consideration of ease of manufacturing and the like.

For reference, although the first pocket 172 of the first resistance part 171 and the second pocket 176 of the second resistance part 175 are shown to be separated from each other in FIG. 1, they may be differently seen depending on the viewing angle. The first pocket 172 and the second pocket 176 are not separated from each other when seen in the plan view.

Meanwhile, at least one of the base body 110 and the resistance body 150 has the friction surface A formed on an outer surface thereof. The friction surface A is formed on the outer surface of either of the base body 110 and the resistance body 150 in a concavo-convex shape and in this embodiment is formed only on the base body 110. In this embodiment, the friction surface A is formed in a substantially rhombic pattern and serves to increase passive resistance of the base body 110.

Figure 4:
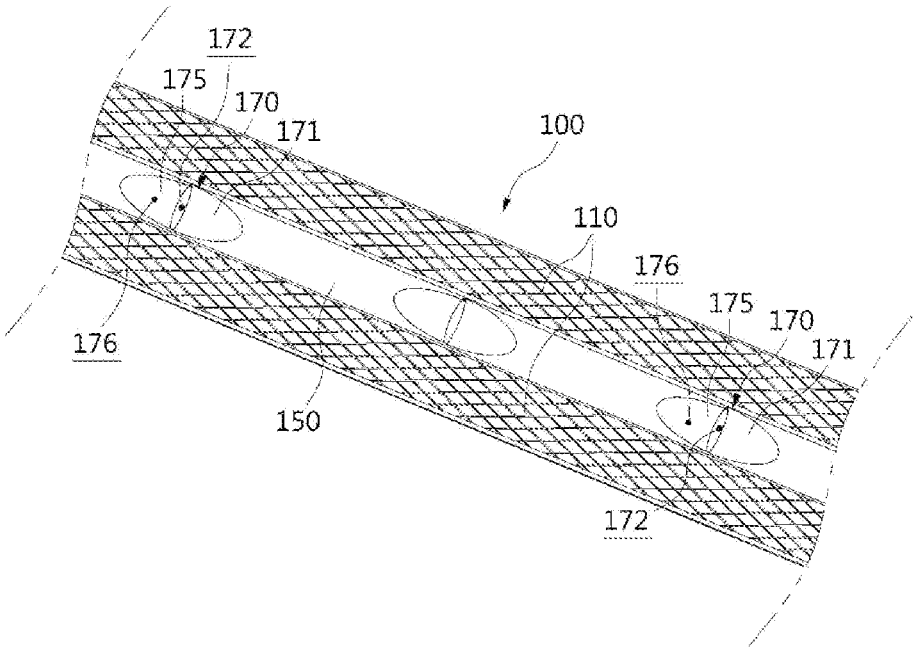
FIG. 4 is a perspective view showing a part of a strip-type reinforcing material according to another embodiment of the present invention.

In this embodiment, the strip-type reinforcing material 100 is provided with two resistance bodies 150. The resistance bodies 150 are spaced apart from each other by a predetermined interval, and each of the resistance bodies 150 has multiple resistance means 170 formed in the longitudinal direction of the strip-type reinforcing material 100. The strip-type reinforcing material 100 may not necessarily be provided with two resistance bodies 150, but may be provided with one resistance body as shown in FIG. 4.

FIG. 3 shows a state in which the strip-type reinforcing material 100 according to the present invention is installed in the backfill soil B. As shown in this figure, the multiple strip-type reinforcing materials 100 may be installed in the backfill soil B at different heights, and may be constructed in a zigzag pattern in each layer so as to reinforce a large area (see FIG. 5).

When the strip-type reinforcing material 100 is installed in the backfill soil B, even when an external force exerts in a direction toward the retaining wall, that is, in a direction toward the mounting block 200 (direction of arrow ①), passive resistance of the strip-type reinforcing material 100 exerts in the opposite direction (direction of arrow ②). This makes it possible to ensure passive resistance and pull-out resistance over a predetermined level, thus improving stability of a reinforced soil retaining wall.

Figure 5:
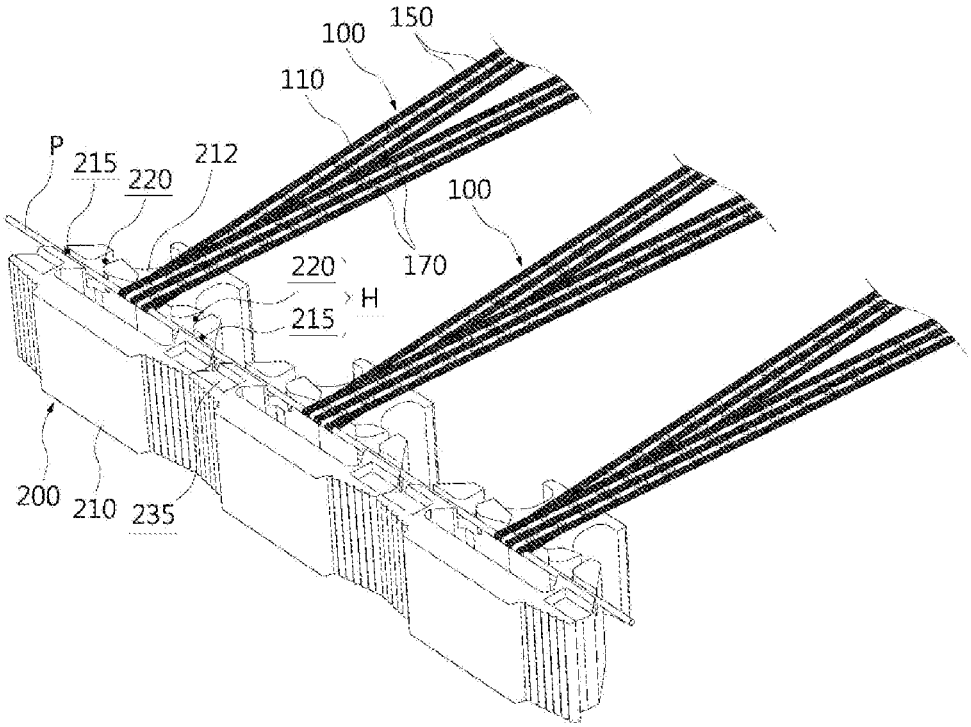
FIG. 5 is an exemplary view showing a state in which the strip-type reinforcing material according to the embodiment of the invention shown in FIG. 1 is connected to a mounting block.
Figure 6:
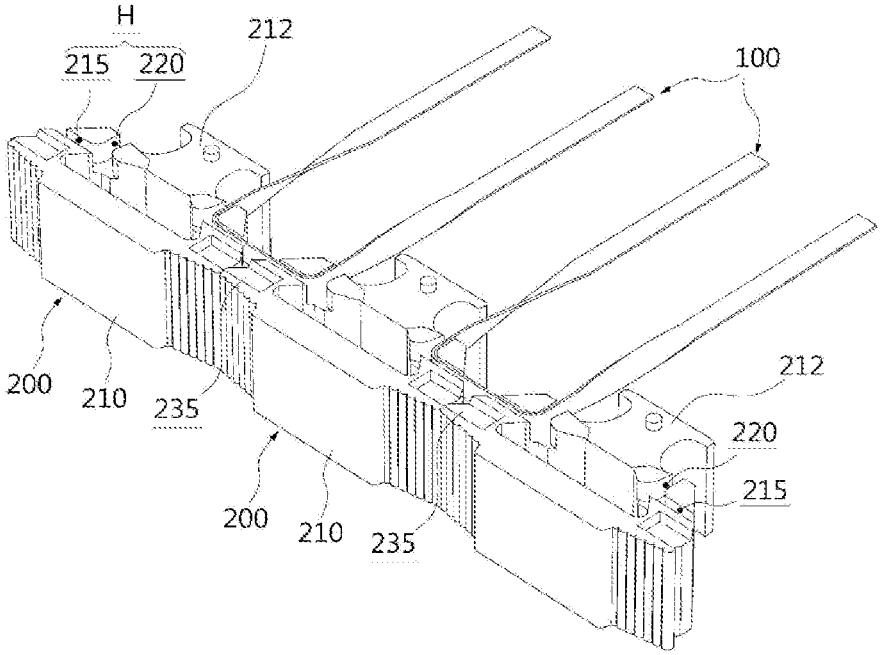
FIG. 6 is an exemplary view showing a state in which the strip-type reinforcing material according to the embodiment of the invention shown in FIG. 1 is connected to the mounting block in a manner different from FIG. 5.

Next, a description will be given of the mounting block 200 constituting the embodiment of the present invention. The mounting block 200 is installed on the front of the soil mass such that multiple mounting blocks 200 are stacked on top of each other or arranged side by side. In FIGS. 5 and 6, the mounting blocks 200 are arranged side by side horizontally, but the mounting blocks 200 may be stacked on top of each other.

The mounting block 200 has a block body 210 conforming to a profile thereof. The block body 210 is configured such that at least a portion of an upper surface thereof is recessed by the thickness of the strip-type reinforcing material 100 to form a seat surface 212. Due to provision of the seat surface 212 being recessed, when the strip-type reinforcing material 100 is seated thereon, the strip-type reinforcing material 100 is prevented from protruding outwardly of the block by the thickness of the strip-type reinforcing material 100. Accordingly, even when the mounting blocks 200 are stacked on top of each other, it is possible to prevent a phenomenon where an upper mounting block 200 slants forward.

The block body 210 has an insertion groove H into which a portion of the strip-type reinforcing material 100 is inserted and seated. The insertion groove H of the mounting block 200 may be roughly classified into two types: a reinforcing material insertion groove 215 and a post insertion groove 220. The reinforcing material insertion groove 215 is formed as a pair such that the portion of the strip-type reinforcing material 100 is hooked in a standing state and then extends in the opposite direction. Herein, the standing state denotes that the strip-type reinforcing material 100 is bent vertically. As shown in FIG. 6, the portion of the strip-type reinforcing material 100 is hooked by entering the reinforcing material insertion groove 215 in a state of being bent and standing and then being reoriented in the opposite direction. For reference, in FIG. 6, the resistance means 170 of the strip-type reinforcing material 100 is omitted.

Meanwhile, the post insertion groove 220 is a part into which a hook post is inserted and on which the portion of the strip-type reinforcing material 100 seated on the seat surface 212 while the strip-type reinforcing material 100 is in a lying state is hooked. Herein, the lying state denotes, as shown in FIG. 5, that the strip-type reinforcing material 100 extends horizontally. The strip-type reinforcing material 100 is wound on the hook post and then extends in the opposite direction. When the hook post is inserted into the post insertion groove 220 in this state, the strip-type reinforcing material 100 is secured to the mounting block 200.

The block body 210 has a coupling protrusion 230 and a coupling recess 235 formed on opposite sides thereof, respectively. The coupling protrusion 230 protrudes from a side of the block body 210, and the coupling groove 235 is recessed in a shape corresponding thereto. The coupling protrusion 230 is inserted into the coupling groove 235 of an adjacent mounting block 200, whereby a boundary between two mounting blocks 200 adjacent to each other is correctly set in position and may rotate relative to each other to some extent.

According to a reinforcing material assembly comprised of the strip-type reinforcing material 100 and the mounting blocks 200, passive resistance and the pull-out resistance are significantly improved, thus improving stability of the reinforced soil retaining wall. As shown in FIGS. 1 and 3, when an external force exerts on the backfill soil B in which the strip-type reinforcing material 100 is installed to be slid in the direction of the retaining wall (direction of arrow ①), both the strip bases 110 and 150 and the resistance means 170 of the strip-type reinforcing material 100 generate strong passive resistance, thus naturally providing a force exerting to retain the soil in the opposite direction (direction of arrow ②).

Furthermore, the strip-type reinforcing material 100 is constructed without the need of considering orientation. Because the first resistance part 171 and the second resistance part 175 are formed at the strip bases 110 and 150 in directions opposite to one another with respect to the two directional axes, the strip-type reinforcing material 100 is improved in resistance both in the direction toward the retaining wall and in the opposite direction and thus the strip-type reinforcing material 100 finds application in various environments and structures. Furthermore, in terms of construction, a specific installation orientation is eliminated due to the symmetric structure of the strip-type reinforcing material 100, thus making it possible for the strip-type reinforcing material 100 to be more conveniently constructed.

In the description above, although all of the elements of the embodiments of the present disclosure may have been explained as assembled or operatively connected as a unit, the present disclosure is not intended to limit itself to such embodiments. Rather, within the objective scope of the present disclosure, the respective elements may be selectively and operatively combined in any numbers. In addition, the term "comprises", "includes", or "has" described herein should be interpreted not to exclude other elements but to further include such other elements since the corresponding elements may be inherent unless mentioned otherwise. Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

While the exemplary embodiments of the present invention have been described above, the embodiments are only examples of the invention, and it will be understood by those skilled in the art that the invention can be modified in various forms without departing from the technical spirit of the invention. Therefore, the embodiments of the present invention are disclosed only for illustrative purposes and should not be construed as limiting the present invention. The scope of the invention should be determined on the basis of the descriptions in the appended claims, not any specific embodiment, and all equivalents thereof should belong to the scope of the invention.

The invention claimed is:

1. A strip-type reinforcing material, comprising:

a strip base extending in one direction and made of a flexible material; and a plurality of resistance means protruding from respective upper and lower parts of the strip base, wherein, the plurality of resistance means are provided to be arranged along the strip base, and each of the plurality of resistance means includes:

a first resistance part protruding from the upper part of the strip base and having an opening being open in a direction parallel to a longitudinal direction of the strip base; and a second resistance part protruding downwardly from the strip base and having an opening being open in an opposite direction to the opening of the first resistance part, and wherein the first resistance part and the second resistance part have a first pocket and a second pocket, respectively, the first pocket and the second pocket each having the opening being open in the longitudinal direction and the opposite direction respectively, the first pocket and the second pocket being gradually widened toward the respective openings.

2. The strip-type reinforcing material of claim 1, wherein the first resistance part and the second resistance part are provided continuously at the strip base in directions facing each other, such that the first pocket and the second pocket are connected to each other.

3. A strip-type reinforcing material, comprising:

a strip base extending in one direction and made of a flexible material; and a plurality of resistance means protruding from respective upper and lower parts of the strip base, wherein, the plurality of resistance means are provided to be arranged along the strip base, and each of the plurality of resistance means includes:

a first resistance part protruding from the upper part of the strip base and having an opening being open in a direction parallel to a longitudinal direction of the strip base; and a second resistance part protruding downwardly from the strip base and having an opening being open in an opposite direction to the opening of the first resistance part, and wherein the strip base includes:

a base body having reinforcing material provided therein; and a resistance body provided between adjacent base bodies and having the respective resistance means.

4. The strip-type reinforcing material of claim 3, wherein the reinforcing material provided in the base body is provided as a pair of reinforcing materials, and the reinforcing materials are separated from each other.

5. The strip-type reinforcing material of claim 3, wherein at least one of the base body and the resistance body has a friction surface formed on an outer surface thereof.

6. A reinforcing material assembly, comprising:

a plurality of mounting blocks provided on a front of a soil mass such that the plurality of mounting blocks are stacked on top of each other or arranged side by side; and a strip-type reinforcing material connected at a portion thereof to one of the plurality of mounting blocks and installed in the soil mass, thus improving passive resistance, wherein the one of the plurality of mounting blocks includes:

a block body having an insertion groove into which the portion of the strip-type reinforcing material is inserted and seated and a seat surface formed by recessing at least a portion of the block body by a thickness of the strip-type reinforcing material, and the strip-type reinforcing material includes:

a strip base extending in one direction and made of a flexible material; and resistance means protruding from respective upper and lower parts of the strip base, the resistance means including a first resistance part protruding from the upper part of the strip base and a second resistance part protruding from the lower part of the strip base, and wherein the first resistance part has an opening being open in a direction parallel to a longitudinal direction of the strip base, a second resistance part has an opening being open in an opposite direction to the opening of the first resistance part, and the first resistance part and the second resistance part have a first pocket and a second pocket, respectively, the first pocket and the second pocket each having the respective openings being open in the longitudinal direction and opposite direction respectively.

7. The reinforcing material assembly of claim 6, wherein the insertion groove of the one mounting block includes:

a reinforcing material insertion groove formed as a pair such that the portion of the strip-type reinforcing material is hooked in a standing state and then extends in an opposite direction; and a post insertion groove into which a hook post is inserted, wherein the hook post on which the portion of the strip-type reinforcing material seated on the seat surface is hooked in a lying state.

* * * * *